United States Patent [19]

Gueret et al.

[11] Patent Number: 4,549,559

[45] Date of Patent: Oct. 29, 1985

[54] COMBINING DEVICE WITH ANTISTATIC PROPERTIES

[75] Inventors: Jean-Louis H. Gueret, Paris; Jean-Paul C. Beck, Villepinte, both of France

[73] Assignee: L'Oreal, Paris, France

[21] Appl. No.: 477,518

[22] Filed: Mar. 21, 1983

[30] Foreign Application Priority Data

Apr. 22, 1982 [FR] France ..... 82 06901

[51] Int. Cl.[4] ..... A45D 24/00

[52] U.S. Cl. ..... 132/11 R

[58] Field of Search ..... 132/155, 11 R, 37 R

[56] References Cited

U.S. PATENT DOCUMENTS

| | | | |
|---|---|---|---|
| 3,142,305 | 7/1964 | Cosby | 132/155 |
| 4,290,438 | 9/1981 | Price | 132/11 R |
| 4,421,129 | 12/1983 | Wingard | 132/11 R |

*Primary Examiner*—Gregory E. McNeill

*Attorney, Agent, or Firm*—Cushman, Darby & Cushman

[57] ABSTRACT

A comb is formed as a moulded body associated with a rigidifying means. The body is formed of a plastic compound including a plastification agent which may itself be a polymer having high flexibility, and further contains an electrically conductive carbon constituent to render the body antistatic.

20 Claims, 2 Drawing Figures

COMBINING DEVICE WITH ANTISTATIC PROPERTIES

The present invention concerns combing devices, such as combs and brushes, having antistatic properties.

It is known that combs and brushes formed of plastic material often have the drawback of accumulating electrostatic charges during combing. This behaviour has drawbacks both as regards the desired untangling of the hair and as regards its being combed into the desired shape.

To overcome this drawback, attempts have been made to manufacture combs and brushes of conducting materials. In particular the attempt has been made to incorporate electrically conducting materials into the plastic materials used for moulding the combing devices. The conducting materials are usually carbon based additives. It will, however, be found that with increasing amounts of such an additive incorporated into the plastic material, the mechanical strength or the integrity of the combing devices is excessively reduced. For this reason, the quantity of carbon incorporated into the plastic material cannot attain a threshold value at which the electrical conductivity characteristics cease to be inadequate.

In published French Patent Application No. 2,460,198, it has already been proposed to incorporate in the plastic material forming the combing devices, a carbon constituent of a particular type (carbon fibres and/or a powdered carbon gasification product) which gives a satisfactory antistatic effect without causing an unacceptable reduction in the mechanical strength.

The present invention provides a combing device having a moulded body formed of a plastic compound which contains a plastification agent in a quantity of from 10 to 100% by weight in relation to the total weight of the plastic compound, and from 3% to 20% by weight of a carbon constituent in relation to the total weight of the rest of the plastic compound, said combing device further including mechanical stiffening means associated with said body.

In accordance with the invention, it has now been found that an unexpected improvement of the antistatic properties suitable for the combing devices is obtained by incorporating in the compound of the plastic material used for manufacturing the combing devices, in addition to a carbon constituent, a plastification agent which reduces the rigidity of the plastic compound containing it without excessively affecting its mechanical properties such as its tensile strength. The greater the plastification of the plastic compound, the better are the antistatic properties of the combing device, all other factors remaining equal. However, obtaining these excellent antistatic properties without an irksome reduction of the mechanical strength is accompanied by a reduction in rigidity so that the combing devices and particularly the combs made have undue flexibility so the stiffening means is incorporated in the body of the combing device.

The stiffening means is advantageously an elongated element attached to the combing device. It may, for instance, take the form of a channel section element gripping the whole or part of the zone of the combing device carrying the combing teeth or bristles.

In a variant, the stiffening means may comprise an elongated rigid element incorporated in the combing device by a "sandwich" type internal injection.

The plastification agent may, in the conventional way, be a plasticizer for chemically modifying the plastic material used. However, in a particularly advantageous variant, the plastification agent is a polymer which itself has considerable flexibility and, when mixed with the other plastic material(s) present, enhances the flexibility of the mixture. For instance, such a polymer is a polyether sequenced with amide blocks, for instance the polymer sold by the "ATO CHIMIE" Company under the Trade Mark "Pebax".

The plastic material constituting the body may advantageously be a polyamide, especially polyamide 11. The carbon constituent may be a carbon gasification powder and/or carbon fibres; in particular, the carbon constituent may be constituted by a powdered "carbon gasification" product having a specific surface measured by nitrogen adsorption according to the BET method, comprised between 600 and 1500 $m^2/g$ and an index of adsorption of oil (dibutylphthalate) of 0.8 to 6 $cm^3/g$; a variety of such a "carbon gasification" powder is marketed by the Company "AKZO CHEMIE" under the Trade Mark of "KETJENBLACK EC". The nature of this "carbon gasification" powder is more completely defined in the said published French Patent Application No. 2 460 198 which is incorporated herein by way of refenence. In that French Publication it is indicated that the "carbon gasification" product is carbon black formed by incomplete combustion of a heavy hydrocarbon to give a gaseous mixture of carbon monoxide and hydrogen. Such a preparation process is also described in U.S. Pat. No. 2,914,418, U.K. Patent Nos. 734 475 and 780,120, pages 227 of "1967 Petrochemical Handbook" (published Nov. 1967). and pages 1118 to 1122 of "Industrial and Engineering Chemistry" Vol. 8 No. 7.

The body of the combing device according to the invention may comprise any current plastic material having good moulding characteristics. By way of example, there may be cited the polyamides, the polyacetals, polypropylene, polystyrene, polyester resins, polyterephthalates. However, the best results are obtained by using the polyamide 11 better known under the Registered Trade Mark "RILSAN"; the combing devices according to the invention made with this type of plastic material have not only exceptional antistatic properties but also a lubricating contact as well as a low coefficient of friction with hair which is, no doubt, related to the fact that a lower accumulation of electro-static charges is produced.

In order that the invention may more readily be understood there will now be described, by way of purely illustrative and non-restrictive examples, several embodiments of combing devices according to the invention, shown in the attached drawings in which.

Figure 1:
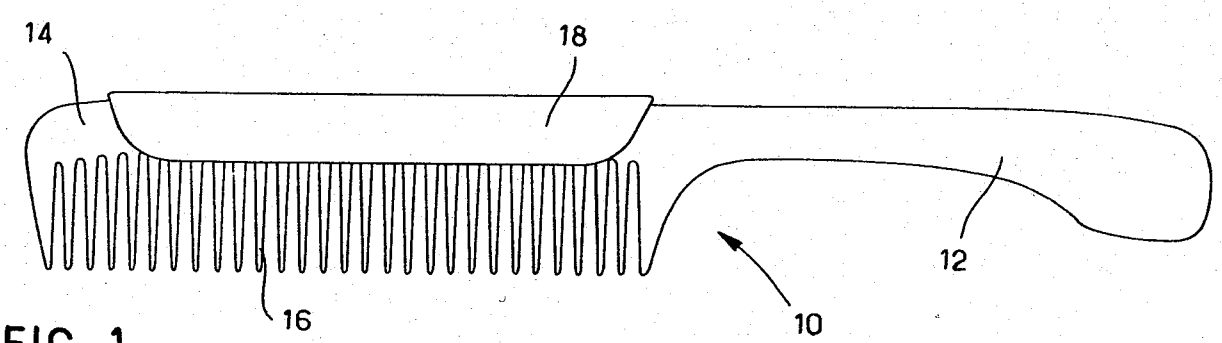
FIG. 1 is a schematic elevation of one comb in accordance with the invention.

FIG. 1 shows a comb 10 of the "hair-dressing" or "tail comb" type, made according to the invention. Its body comprises a handle 12 which is extended in a spine 14 carrying teeth 16. The body 12, 14, 16, is formed from a compound described in detail below. A stiffening element 18 is placed on the spine 14 and has a U-shaped cross section and forms a channel straddling the spine 14 of the comb.

Figure 2:
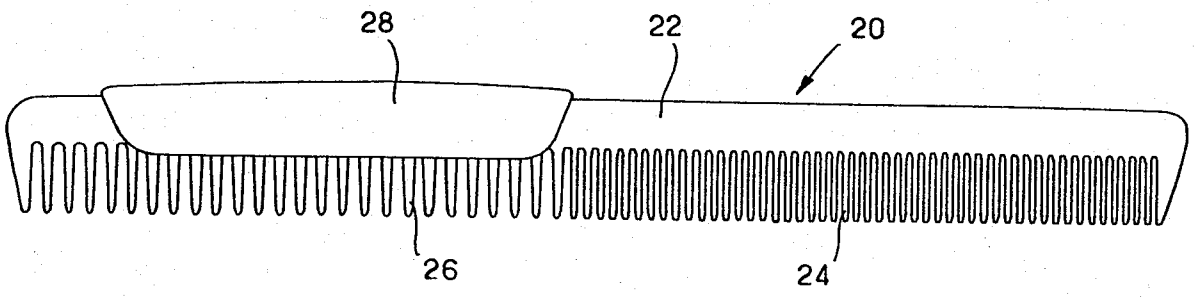
FIG. 2 is a schematic elevation of another comb in accordance with the invention.

FIG. 2 shows another embodiment wherein a plain comb 20 having a spine 22 carries, at one end, fine teeth 24 and at the other end, dressing comb teeth 26. A stiffening element 28, more rigid than the spine 22 may slide along this spine so that it stiffens either the spine part having fine teeth 24 or the spine part having the dressing comb teeth 26. The stiffening element 28 is similar to the stiffening element 18 of FIG. 1 and constitutes a channel straddling the spine 22.

The first component of a combing device according to the invention is the body which although it may have a conventional form is essentially characterised by its composition. This composition contains three main elements namely: a plastic material, an electrically conducting carbon constituent and a plasticizing agent.

The plastic material of the body is, in this example, a polyamide 11 of the type known under the Registered Trade Mark of "Rilsan".

The plastification agent used in this example is a polymer compatible with the plastic material used, and having considerable flexibility, that is to say a polyether sequenced with amide blocks, of the type sold by the "ATO CHIMIE" Company under the Trade Mark "Pebax". The ponderal quantity of the "Pebax" polymer, determined in relation to the weight of the "Rilsan" used, has been found to be at least 25%.

The electrically conducting constituent used is carbon black obtained by gasification (for example incomplete combustion of heavy hydrocarbons), and may for example be the product sold under the Trade Mark "Ketjenblack EC". This charge is present to the extent of 10% by weight in relation to the combined weights of the "Rilsan" and "Pebax" constituents.

The stiffening element 18 or 28 is simply intended to impart a greater rigidity to the otherwise excessively flexible body. It is formed of a rigid plastic material, in this example, of un-plasticized "Rilsan". It is not mandatory for the plastic material forming the stiffening element to have antistatic properties. However, it is desirable that it should contain a small quantity of any kind of carbon constituent so that it should have the same appearance as the body.

There will now be given below particular examples of the embodiment of the combing devices according to the invention.

For making a comb body, a compound A is prepared, containing 50% of "Rilsan" (R.T.M.) and 50% of "Pebax" of a grade referenced "4011 RN 00". The physical properties of this "Pebax" plasticizing agaent appear in the following Table I:

TABLE 1

| | |
|---|---|
| Specific Gravity | 1.14 |
| Melting Point, °C. | 190 |
| Modulus of elasticity, MPa | 110 |
| Modulus of torsional rigidity, MPa | 35 |
| Shore hardness D | 40 |
| Surface resistance Ω at 20° C. and 65% of relative humidity, ohms | $10^8$ |

To this, there is added an amount of "Ketjenblack EC" carbon gasification powder in a quantity equal to 10% by weight in relation to the accumulated weights (Rilsan+Pebax). The "Ketjenblack EC" properties are given in the following Table II:

TABLE II

| | |
|---|---|
| Iodine index according to the ASTM standard of the U.S.A. | 950 mg/g |
| Specific surface measured by nitrogen adsorption according to the BET method | 1000 $m^2/g$ |
| Particle dimensions | 30 nm |

TABLE II-continued

| | |
|---|---|
| Volatile substances (by weight) | 1% |
| Ashes (by weight) | 0.5% |
| Impurities (by weight) | 0.02% |
| Apparent specific mass | 150 g/l |

A compound B is then prepared containing "Rilsan" without a plasticizer having the same relative quantity of the "Ketjenblack EC" carbon constituent added, that is to say, 10% by weight in relation to the weight of the "Rilsan".

The two compounds A and B are then used to form consistencies containing respectively 0, 20, 50 and 100% of compound A, the rest (if any) being constituted by compound B. Therefore in all, there are four different compounds available and from these combs are moulded. Table III below indicates the composition of each of the combs as well as the electric field determined as indicated below. Composition No. 1 is given by way of reference but does not form part of the invention since it does not contain any plasticizer.

TABLE III

| Composition No. | Compound % B | Compound % A | Electric field kV/m |
|---|---|---|---|
| 1 | 100 | 0 | −400 |
| 2 | 80 | 20 | −350 |
| 3 | 50 | 50 | −250 |
| 4 | 0 | 100 | −30 |

The electric field measured for determining the antistatic properties of the four combs obtained with the compositions Nos. 1 to 4 is determined by means of locks of hair previously washed with an aqueous solution with 2% by weight of sodium laurylsulphate. The values of the table are obtained by means of an electric field measuring instrument placed 10 cms. from the locks of hair after each one had been combed 25 times.

The results set out in Table III show that the electrostatic charge accumulated progressively decreases as the quantity of the plastification agent increases; the electrostatic charge accumulated is extremely low in the case of a plastic having 100% of a plastification agent and negligible polyamide (Composition No. 4).

Although a particular type of plastic material, a particular type of plastification agent and a particular type of carbon constituent have been described above, these various materials may, however, be different. Moreover, the stiffening elements have only been indicated by way of illustration. The stiffening element may, for example, be embedded within the body by compound injection moulding. It shall be duly understood that the combing devices described above may give rise to any desirable modifications without departing thereby from the scope of the invention as defined by the following claims.

We claim:

1. In a combing device, formed by moulding of a composition containing at least one plastic material and a carbon constituent, the improvement wherein it comprises:

(a) a body formed of a compound which contains (aa) at least one plastic material (ab) at least one plasticizer for said at least one plastic material in a quantity of from 25% to 100% by weight in relation to the total weight of the said at least one plastic before addition of the plasticizer, and (ac) from 3 to 20% by weight of said carbon constituent expressed in relation to the total formed by the at least one plastic material and said at least one plasticizer and, (b) mechanical stiffening means associated with said body.

2. A combing device according to claim 1, wherein the device is a comb and said stiffening means comprises a rigid and elongate element attached to the body.

3. A combing device according to claim 1, wherein the device is a comb and said stiffening means comprises a channel-section element at least partly gripping the body.

4. A combing device according to claim 1, wherein said stiffening means is a rigid elongate element incorporated in said body.

5. A combing device according to claim 1, wherein said at least one plastic material constituting the body is a polyamide.

6. A combing device according to claim 5, wherein said polyamide is polyamide 11.

7. A combing device according to claim 1, wherein said carbon constituent is at least one of: a powdered carbon gasification product and carbon fibres.

8. A combing device according to claim 7, wherein the carbon constituent is a powdered carbon gasification product having a specific surface, measured by nitrogen adsorption according to the BET method, of from 600 to 1500 $m^2/g$ and an index of adsorption of oil (dibutylphthalate) of from 0.8 to 6 $cm^3/g$.

9. In a combing device, formed by moulding a composition containing at least one plastic material and a carbon constituent, the improvement wherein it comprises:

(a) a body formed of a compound which contains (aa) at least one plastic material, (ab) at least one plastification agent which imparts to said compound a flexibility greater than that of the said at least one plastic material alone, said plastification agent being present in the compound in an amount of from 25 to 100% by weight in relation to the total weight of said at least one plastic material including said plastification agent, and (ac) from 3 to 20% by weight of said carbon constituent expressed in relation to the total weight of said at least one plastic material and said at least one plastification agent and, (b) mechanical stiffening means associated with said body.

10. A combing device according to claim 9, wherein the device is a hair comb and said stiffening means comprises a rigid and elongate element attached to the body.

11. A combing device according to claim 9, wherein said device is a hair comb and said stiffening means comprises a channel-section element at least partly gripping the body.

12. A combing device according to claim 9, wherein said stiffening means is a rigid elongate element incorporated in said body.

13. A combing device according to claim 9, wherein the plastification agent is a polymer having high flexibility.

14. A combing device according to claim 13, wherein the polymer having high flexibility is a polyether sequenced with amide blocks.

15. A combing device according to claim 14, wherein said polyether sequenced with amide blocks is grafted to a polyamide.

16. A combing device according to claim 9, wherein said at least one plastic material constituting the body is a polyamide.

17. A combing device according to claim 16, wherein said polyamide is polyamide 11.

18. A combing device according to claim 14, wherein said at least one plastic material constituting the body is a polyamide.

19. A combing device according to claim 9, wherein said carbon constituent is at least one of: a powdered carbon gasification product and carbon fibres.

20. A combing device according to claim 19, wherein the carbon constituent is constituted by a powdered carbon gasification product having a specific surface measured by nitrogen adsorption according to the BET method, of from 600 to 1500 $m^2/g$ and an index of adsorption of oil (dibutylphthalate) of from 0.8 to 6 $cm^3/g$.

* * * * *

UNITED STATES PATENT AND TRADEMARK OFFICE

CERTIFICATE OF CORRECTION

PATENT NO. : 4,549,559

DATED : October 29, 1985

INVENTOR(S) : GUERET et al

It is certified that error appears in the above-identified patent and that said Letters Patent is hereby corrected as shown below:

The Title should read

--Combing Device With Antistatic Properties--.

Signed and Sealed this

*Fourth* Day of *February 1986*

[SEAL]

*Attest:*

DONALD J. QUIGG

*Attesting Officer*

*Commissioner of Patents and Trademarks*